United States Patent [19]

Jones et al.

[11] 3,969,251

[45] July 13, 1976

[54] DEVELOPER MIXTURE

[75] Inventors: Lewis O. Jones, Webster; Robert Mermelstein, Rochester, both of N.Y.

[73] Assignee: Xerox Corporation, Stamford, Conn.

[22] Filed: May 30, 1974

[21] Appl. No.: 474,488

[52] U.S. Cl. ..... 252/62.1 P; 96/1 SD

[51] Int. Cl.[2] ..... G03G 9/02

[58] Field of Search..... 96/1 SD; 117/17.5; 252/62.1; 427/25, 26, 27

[56] References Cited

UNITED STATES PATENTS

| | | | |
|---|---|---|---|
| 3,236,776 | 2/1966 | Tomanek | 252/62.1 |
| 3,239,465 | 3/1966 | Rheinfrank | 252/62.1 |
| 3,345,294 | 10/1967 | Cooper | 252/62.1 |
| 3,669,922 | 6/1972 | Bartsch et al. | 96/1 SD |
| 3,745,118 | 7/1973 | Brynko | 252/62.1 |

*Primary Examiner*—David Klein
*Assistant Examiner*—John L. Goodrow

[57] ABSTRACT

An electrostatographic developer mixture comprising classified toner materials electrostatically clinging to the surface of classified high surface area carrier materials said classified toner materials having a particle size number distribution with a fine index ratio of less than about 2.50, a particle size volume distribution with a coarse index ratio less than about 1.50, and a particle size distribution wherein less than about 30.0 percent by number of the toner particles have an average particle size diameter of less than about 5 microns, about 25% of the particles have diameter between about 8 microns and about 12 microns, and less than about 5% by number of the toner particles have an average particle diameter greater than about 20 microns, said classified high surface area carrier materials having a specific surface area of at least about 150 $cm^2$/gram.

15 Claims, No Drawings

DEVELOPER MIXTURE

BACKGROUND OF THE INVENTION

This invention relates in general to electrostatographic imaging systems, and, in particular, to improved developer materials and their use.

The formation and development of images on the surface of photoconductive materials by electrostatic means is well-known. The basic electrostatographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resulting electrostatic latent image by depositing on the image a finely-divided electroscopic material referred to in the art as "toner." The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light-and-shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing step.

Many methods are known for applying the electroscopic particles to the electrostatic latent image to be developed. One development method, as disclosed by E. N. Wise in U.S. Pat. No. 2,618,552 is known as "cascade" development. In this method, developer material comprising relatively large carrier particles having finely-divided toner particles electrostatically clinging to the surface of the carrier particles is conveyed to and rolled or cascaded across the electrostatic latent image-bearing surface. The composition of the toner particles is so chosen as to have a triboelectric polarity opposite that of the carrier particles. In order to develop a negatively charged electrostatic latent image, an electroscopic powder and carrier combination should be selected in which the powder is triboelectrically positive in relation to the carrier. Conversely, to develop a positively charged electrostatic latent image, the electroscopic powder and carrier should be selected in which the powder is triboelectrically negative in relation to the carrier. This triboelectric relationship between the powder and carrier depends on their relative positions in a triboelectric series in which the materials are arranged in such a way that each material is charged with a positive electrical charge when contacted with any material below it in the series and with a negative electrical charge when contacted with any material above it in the series. As the mixture cascades or rolls across the imagebearing surface, the toner particles are electrostatically deposited and secured to the charged portions of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier particles and unused toner particles are then recycled. This technique is extremely good for the development of line copy images. The cascade development process is the most widely used commercial electrostatographic development technique. A general purpose office copying machine incorporating this technique is described in U.S Pat. No. 3,099,943.

Another technique for developing electrostatic images is the "magnetic brush" process as disclosed, for example, in U.S. Pat. No. 2,874,063. In this method a developer material containing toner and magnetic carrier particles is carried by a magnet. The magnetic field of the magnet causes alignment of the magnetic carriers in a brush-like configuration. This "magnetic brush" is engaged with an electrostatic latent image-bearing surface and the toner particles are drawn from the brush to the electrostatic image by electrostatic attraction. Many other methods such as "touchdown" development as disclosed by C. R. May in U.S. Pat. No. 2,895,847 are known for applying electroscopic particles to the electrostatic latent image to be developed. The development processes as mentioned above, together with numerous variations, are well-known to the art through various patents and publications and through the widespread availability and utilization of electrostatographic imaging equipment.

In automatic electrostatographic equipment, it is conventional to employ an electrostatographic plate in the form of a cylindrical drum which is continuously rotating through a cycle of sequential operations including charging, exposure, developing, transfer and cleaning. The plate is usually charged with corona with positive polarity by means of a corona generating device of the type disclosed by L. W. Walkup in U.S. Pat. No. 2,777,957 which is connected to a suitable source of high potential. After forming a powder image is electrostatically transferred to a support surface by means of a corona generating device such as the corona device mentioned above. In automatic equipment employing a rotating drum, a support surface to which a powdered image is to be transferred is moved through the equipment at the same rate as the periphery of the drum and contacts the drum in the transfer position interposed between the drum surface and the corona generating device. Transfer is effected by the corona generating device which imparts an electrostatic charge to attract the powder image from the drum to the support surface. The polarity of charge required to effect image transfer is dependent upon the visual form of the original copy relative to the reproduction and the electroscopic characteristics of a developing material employed to effect development. For example, where a positive reproduction is to be made of a positive original, it is conventional to employ a positive polarity corona to effect transfer of a negatively charged toner image to the support surface. When a positive reproduction from a negative original is desired, it is conventional to employ a positively charged developing material which is repelled by the charged areas on the plate to the discharge areas thereon to form a positive image which may be transferred by negative polarity corona. In either case, a residual powder image and, occasionally, carrier particles remain on the plate after transfer. Before the plate may be reused for a subsequent cycle, it is necessary that the residual image and carrier particles, if any, be removed to prevent ghost images from forming on subsequent copies. In the positive-to-positive reproduction process described above, the residual developer powder, as well as any carrier particles present, are tightly retained on the plate surface by a phenomenon that is not fully understood but believed caused by an electric charge. The charge is substantially neutralized by means of a corona generating device prior to contact of the residual powder with a cleaning device. The neutralization of the charge enhances the cleaning efficiency of the cleaning device.

Typical electrostatographic cleaning devices include the "web" type cleaning apparatus as disclosed, for example, by W. P. Graff, Jr., et al in U.S Pat. No. 3,186,838. In the Graff, Jr., et al. Patent, removal of the residual powder and carrier particles on the plate is effected by rubbing a web of fibrous material against the imaging plate surface. These inexpensive and disposable webs of fibrous material are advanced into pressure and rubbing or wiping contact with the imaging surface and are gradually advanced to present a clean surface to the plate whereby substantially complete removal of the residual powder and carrier particles from the plate is effected.

While ordinarily capable of producing good quality images, conventional developing systems suffer serious deficiencies in certain areas. In the reproduction of high contrast copies such as letters, tracings and the like, it is desirable to select the electroscopic powder and carrier materials so that their mutual electrification is governed in most cases by the distance between their relative positions in the triboelectric series. However, when otherwise compatible electroscopic powder and carrier materials are removed from each other in the triboelectric series by too great a distance, the resulting images are very faint because the attractive forces between the carrier and toner particles compete with the attractive forces between the electrostatic latent image and the toner particles. Although the image density described in the immediately preceding sentence may be improved by increasing the toner concentration in the developer mixture, undesirably high background toner deposition as well as increased toner impaction and agglomeration is encountered when the toner concentration in the developer mixture is excessive. The initial electrostatographic plate charge may be increased to improve the density of the deposited powder image, but the plate charge would ordinarily have to be excessively high in order to attract the electroscopic powder away from the carrier particle. Excessively high electrostatographic plate charges are not only undesirable because of the high power consumption necessary to maintain the electrostatographic plate at high potentials, but also because the high potential causes the carrier particles to adhere to the electrostatographic plate surface rather than merely roll across and off the electrostatographic plate surface. Print deletion and massive carryover of carrier particles often occur when carrier particles adhere to reusable electrostatographic imaging surfaces. Massive carrier carry-over problems are particularly acute when the developer is employed in solid area coverage machines where excessive quantities of toner particles are removed from carrier particles thereby leaving many carrier particles substantially bare of toner particles. Further, adherence of carrier particles to reusable electrostatographic imaging surfaces promotes the formation of undesirable scratches on the surfaces during image transfer and surface cleaning operations. It is therefore, apparent that many materials which otherwise have suitable properties for employment as developer materials are unsuitable because they possess unsatisfactory triboelectric properties. In addition, uniform triboelectric surface characteristics of many carrier surfaces are difficult to achieve with mass production techniques. Quality images are in some instances almost impossible to obtain in high speed automatic machines when carriers having non-uniform triboelectric properties are employed. Although it may be possible to alter the triboelectric value of an insulating carrier material by blending the carrier material with another insulating material having a tribolectric value remote from the triboelectric value of the original carrier material, relatively larger quantities of additional material is necessary to alter the triboelectric value of the original carrier material. The addition of large quantities of material to the original carrier material to change the triboelectric properties thereof requires a major manufacturing operation and often undesirably alters the original physical characteristics of the carrier material. Further, it is highly desirable to control the triboelectric properties of carrier surfaces to accommodate the use of desirable toner compositions while retaining the other desirable physical characteristics of the carrier. Another factor affecting the stability of the triboelectric properties of developer materials is the susceptibility of developer particles to "toner impaction". When developer particles are employed in automatic machines and recycled through many cycles, the many collisions which occur between the carrier particles and other surfaces in the machine cause the toner particles carried on the surface of the carrier particles to be welded or otherwise forced onto the carrier surfaces. The gradual accumulation of impacted toner material on the surface of the carrier causes a change in the triboelectric value of the carrier and directly contributes to the degradation of copy quality by eventual destruction of the toner carrying capacity of the carrier.

Thus, there is a continuing need for a better developer material for developing electrostatic latent images.

SUMMARY OF THE INVENTION

It is, therefore, an object of this invention to provide developer materials which overcome the above noted deficiencies.

It is another object of this invention to provide developer materials which are more resistant to agglomeration and have improved dispensing characteristics.

It is yet another object of this invention to provide developer materials having more stable electrostatographic properties.

It is yet another object of this invention to provide developer materials which have a longer developer life.

It is yet another object of this invention to provide developer materials which are less susceptible to toner impaction.

It is yet another object of this invention to provide developer materials which are more resistant to film formation on electrostatographic recording surfaces.

Another object of this invention is to provide developer materials which exhibit improved electrical and mechanical properties useful in an electrostatographic apparatus employing magnetic brush development apparatus.

A still further object of this invention is to provide improved developer materials having physical and chemical properties superior to those of known developer materials.

The above objects and others are accomplished, generally speaking, by providing electrostatographic developer materials comprising classified toner materials electrostatically charging to the surface of classified charge surface area carrier materials, said classified toner materials having a particle size number distribution with a fine index ratio of less than about 2.50, a particle size volume distribution with a coarse index ratio less than about 1.50, and a particle size distribution wherein less than about 30.0 percent by number of the toner particles have an average particle size diameter of less than about 5 microns, about 25 percent of the particles have a diameter between about 8 microns and about 12 microns and less than about 5 percent by number of the toner particles have an average particle diameter greater than about 20 microns; said classified high surface area carrier materials having a specific surface area of at least about 150 $cm^2$/gram. However, it is preferred that the carrier materials have a specific surface area of at least about 165 $cm^2$/gram because developer life is improved such as to provide increased copy quantity with the developer material in a high speed electrostatographic reproduction apparatus while maintaining low background levels and sustaining solid area development density. Optimum results are obtained when the carrier materials of this invention have a specific surface area of at least about 175 $cm^2$/gram.

It has been found that the area ratios of carrier to toner material in a high speed magnetic brush development system were such that the toner concentration could not be sufficiently reduced to enable a charge level for minimal deposit of toner material in background areas of an electrostatic latent image during development thereof while retaining sufficient toner concentration to provide satisfactory solid area density. By providing the carrier materials of this invention having a minimum specific surface area this problem has been overcome. Thus, this invention now enables the use of a developer mixture having a low toner concentration per unit surface area of carrier to provide a higher net electrical charge level. It has been found that in the electrostatic copying process that where any given carrier material is employed to provide a triboelectric charge to toner materials by contact charge transfer, the area of carrier triboelectric charging surface is critically important. The carrier charging surface area has been found to relate to the amount of toner material that, for a given toner material, can be charged to a useful triboelectric potential or level. Therefore, in accordance with this invention, it has been found that the triboelectric charging capacity of a carrier material is surface area dependent and accordingly, this invention may be employed to design optimum developer materials for any given electrostatographic development system.

The term coarse index is defined as the ratio of the volume distribution of particle size diameter of 84 percent of the toner particles divided by the particle size diameter of 50 percent of the toner particles. Similarly, the term fine index is defined as the ratio of the number distribution of particle size diameter of 50 percent of the toner particles divided by the particle size diameter of 16 percent of the toner particles. Both the coarse index and fine index ratios are calculated from the respective volume and number cumulative frequency plots which are obtained from particle size analysis performed on a Coulter Counter employing a 100 micron orifice. The former value represents the median or average particle size distribution by weight or volume of the toner particles and has an important influence on the copy quality obtained in an electrostatographic development system. The fine index is a measure of the toner particles number average distribution, weighted on the fine end, and has an important reflection on the measure of the useful lifetime of the developer, the systems life, rate of photoreceptor filming and rate of toner impaction on the electrostatographic recording surface.

It has been found that the classified developer materials of this invention provide satisfactory results when the particle size number distribution fine index of the toner particles is less than about 2.50. Improved results are obtained with, and it is preferred, that the particle size number distribution fine index thereof is less than about 2.00. Optimum results are obtained when the particle size number distribution fine index of the classified toner materials is less than about 1.45. Similarly, satisfactory results are obtained with the classified developer materials of this invention when the particle size volume distribution coarse index of the toner particles is less than about 1.50. However, it is preferred that the particle size volume distribution coarse index thereof be less than about 1.45 because improved resolution and edge definition is obtained on the copies. Optimum results are obtained when the particle size volume distribution coarse index of the toner materials is less than about 1.35.

In addition, it has been found that the classified toner materials of this invention provide satisfactory results when the particle size distribution thereof is such that less than about 30.0 percent by number of the toner particles have an average particle diameter of less than about 5 microns, about 25.0 percent by number of the toner particles have an average particle diameter of between about 8 microns and about 12 microns, and less than about 5.0 percent by number of the toner particles have an average particle diameter greater than about 20 microns. However, it is preferred that the particle size distribution be such that less than about 20 percent by number of the toner particles have an average particle diameter of less than about 5 microns, about 45 percent by number of the toner particles have an average particle diameter of between about 8 microns and about 12 microns, and less than about 5 percent by number of the toner particles have an average particle diameter greater than about 20 microns. Optimum results are obtained when the particle size distribution is such that less than about 10 percent by number of the toner particles have an average particle diameter of less than about 5 microns, about 60 percent by number of the toner particles have an average particle diameter of between about 8 microns and about 12 microns, and less than about 5 percent by number of the toner particles have an average particle diameter greater than about 20 microns.

It has been found that the classified carrier materials of this invention provide satisfactory results when the particle size volume distribution geometric standard deviation thereof is less than axout 1.3 and the volume average particle diameter is less than about 100 microns. Improved results are obtained with, and it is preferred, that the particle size volume distribution geometric standard deviation thereof be less than about 1.2 and the volume average particle diameter is less than about 90 microns. Optimum results are obtained when the volume distribution geometric standard deviation of the classified carrier materials of this invention is less than about 1.15 and the volume average particle diameter is less than about 85 microns. The term geometric standard deviation as employed herein is defined as the deviation encountered in a particle size analysis approximately measured as the ratio of the particle diameter which is greater than that of 84 percent of the sample to that of the particle diameter which is greater than that of 50 percent of the sample. This value represents the median or average particle size distribution by weight or volume of the carrier particles and has an important reflection on copy quality obtained in an electrostatographic development system. Another measure of the geometric standard deviation of the classified carrier materials of this invention is the deviation encountered in a particle size analysis approximately measured as the ratio of the particle diameter which is greater than that of 50 percent of the sample to that of the particle diameter which is greater than that of 16 percent of the sample. The 50 percent value represents the median or average particle size by volume of the carrier particles and has an important reflection on the measure of the useful lifetime of the developer. In both cases, the values obtained for the volume average particle diameter and the geometric standard deviation are determined by size analysis performed by a sieve analysis employing all U.S. Standard sieves from 325 mesh to 70 mesh.

Any suitable particle classification method may be employed to obtain the classified toner materials of this invention. Typical particle classification methods include air classification, screening, cyclone separation, elutriation, centrification, and combinations thereof. The preferred method of obtaining the classified toner materials of this invention is by centrifugal air classification. In this method, air or some other gas flows inwards in a spiral path through a flat, cylindrical chamber. Particles contained in the air flow are exposed to two antagonistic forces, viz., to the inwardly directed tractive force of the air, and to the outwardly directed centrifugal force of the particle. For a definite size of particles, that is, the "cut size," both forces are in equilibrium. Larger (heavier) particles are dominated by the mass-dependent centrifugal force and the smaller (lighter) particles by the frictional force proportional to the particle diameter. Consequently, the larger or heavier particles fly outwards as coarse fraction, while the smalleer or lighter ones are carried inwards by the air as fine fraction. The "cut size" usually depends upon the gradient of the spiral, the peripheral component, and the absolute dimension of the classifying chamber. Adjustment of the "cut size" may be effected through variation of the two factors first mentioned, while the range of the "cut size" may be determined by the respective dimension of the classifying chamber. Satisfactory centrifugal air classification results may be obtained when employing an apparatus such as the Mikroplex Spiral Air Classifier Type 132MP model available from the Alpine American Corporation, Natick, Massachusetts, or an Acucut Model B18 unit available from the Donaldson Company, Inc., Tulsa, Oklahoma.

Any suitable particle classification method may be employed to obtain the high surface area carrier materials of this invention. Typical particle classification methods include air classification, screening, cyclone separation, elutriation, centrification, and combinations thereof. The preferred method of obtaining the high surface area carrier materials of this invention is by screening or seiving.

Any suitable vinyl resin having a melting point of at least about 110° F may be employed in the toner compositions. The vinyl resin may be a homopolymer or a copolymer of two or more vinyl monomers. Typical monomeric units which may be employed to form vinyl polymers include: styrene, p-chlorostyrene, vinyl naphthalene; ethylenically unsaturated monoolefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrole, N-vinyl carbazole, N-vinyl indole, N-vinyl pyrrolidene and the like; and mixtures thereof. Generally, suitable vinyl resins employed in the toner have a weight average molecular weight between about 3,000 to about 500,000.

Toner resins containing relatively high percentages of a styrene resin are preferred. The presence of a styrene resin is preferred because a greater degree of image definition is generally achieved upon latent image development. Further, denser images are obtained when at least about 25 percent by weight, based on the total weight of resin in the toner, of a styrene resin is present in the toner. The styrene resin may be a homopolymer of styrene or styrene homologues or copolymers of styrene with other monomeric groups containing a single methylene group attached to a carbon atom by a double bond. Thus, typical monometric materials which may be copolymerized with styrene by addition polymerization include: P-chlorostyrene, vinyl naphthalene; ethylenically unsaturated monoolefins such as theylene, propylene, butylene, isobuthlene and the like; vinyl esters such as vinyl chloride, vinyl bromide, vinyl fluoride, vinyl acetate, vinyl propionate, vinyl benzoate, vinyl butyrate and the like; esters of alpha-methylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like, vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyroole, N-vinyl carbazole, N-vinyl indole, N-vinyl pyrrolidene and the like; and mixtures thereof. The styrene resins may also be formed by the polymerization of mixtures of two or more of these unsaturated monomeric materials with a styrene monomer. The expression "addition polymerization" is intended to include known polymerization techniques such as free radical, anionic and cationic polymerization processes.

The vinyl resins, including styrene type reins, may also be blended with one or more other resins if desired. When the vinyl resin is blended with another resin, the added resin is preferably another vinyl resin because the resulting blend is characterized by especially good triboelectric stability and uniform resistance against physical degradation. The vinyl resins employed for blending with the styrene type or other vinyl resin may be prepared by the addition polymerization of any suitable vinyl monomer such as the vinyl monomers described above. Other thermoplastic resins may also be blended with the vinyl resins of this invention. Typical non-vinyl type thermoplastic resins include: rosin modified phenol formaldehyde resins, oil modified epoxy resins, polyurethane resins, cellulosic resins, polyether resins and mixture thereof. When the resin component of the toner contains styrene copolymerized with another unsaturated monomer or a blend of polystyrene and another resin, a styrene component of at least about 25 percent by weight based on the total weight of the resin present in the toner is preferred because denser images are obtained and a greater degree of image definition is achieved with a given quantity of toner material.

It is to be understood that the specific formulas given for the units contained in the resins of the toner materials re-present the vast majority of the units present, but do not exclude the presence of monomeric units or reactants other than those which have been shown. For example, some commercial materials contain trace amounts of homologues or unreacted or partially reacted monomers. Any minorr amount of such substituents may be present in the materials of this invention.

Any suitable pigment or dye may be employed as the colorant for the toner particles. Toner colorants are well-known and include, for example, carbon black, nigrosine dye, aniline blue, Calco Oil Blue, chrome yellow, ultramarine blue, duPont Oil Red, Qunioline Yellow, emthylene blue chloride, phthalocyanine blue, Malachite Green Oxalate, lamp black, Rose Bengal and mixtures thereof. The pigment or dye should be present in the toner in a sufficient quantity to render it highly colored so that it will form a clearly visible image on a recording member. Thus, for example, where conventional electrostatographic copies of typed documents are desired, the toner may comprise a black pigment such as carbon black, for example, furnace black or channel black, or a black dye such as Amaplast Black dye, available from the National Aniline Products, Inc. Generally, the pigment is employed in an amount from about 1 percent to about 20 percent by weight based on the total weight of the colored toner. If the toner colorant employed is a dye, substantially smaller quantities of colorant may be used. However, since a number of the above pigments used in electrostatographic toner compositions may affect both the glass transition and fusion temperatures of the toner compositions of this invention, their concentration preferably should be about 10 percent by weight of the colored toner.

The toner compositions may be prepared by any well-known toner mixing and comminution technique. For example, the ingredients may be thoroughly mixed by blending, mixing and milling the components and thereafter micropulverizing the resulting mixture. Another well-known technique for forming toner particles is to spray-dry a ball-milled toner composition comprising a colorant, a resin, and a solvent.

Any suitable coated or uncoated electrostatographic carrier bead material may be employed as the high surface area carrier material of this invention. Typical cascade development process carriers include sodium chloride, ammonium chloride, aluminum potassium chloride, Rochelle salt, sodium nitrate, aluminum nitrate, potassium chlorate, granular zircon, granular silicon, methyl methacrylate, glass and silicon dioxide. Typical magnetic brush development process carriers include nickel, steel, iron, ferrites, and the like. The carriers may be employed with or without a coating. Many of the foregoing and other typical carriers are described by L. E. Walkup, et al. in U.S. Pat. No. 2,638,416 and E. N. Wise in U.S. Pat. No. 2,618,552. An ultimate coated carrier particle diameter between about 30 microns to about 1,000 microns is preferred because the carrier particles then possess sufficient density and inertia to avoid adherence to the electrostatic images during the cascade development process. For magnetic brush development, the carrier particles generally have an average diameter between about 30 microns and about 250 microns. Generally speaking, satisfactory results are obtained when about 1 part toner is used with about 10 to 200 parts by weight of carrier.

The high surface area carrier materials of this invention may be coated with any suitable coating material. Typical electrostatographic carrier particle coating materials include vinyl chloride-vinyl acetate copolymers, styrene-acrylate-organosilicon terpolymers, natural resins such as caoutchouc, colophony, copal, dammar, Drangon's Blood, jalap, storax; thermoplastic resins including the polyolefins such as polyethylene, polypropylene, chlorinated polyethylene, and chlorosulfonated polyethylene; polyvinyls and polyvinylidenes such as polystyrene, polymethylstyrene, polymethyl methacrylate, polyacrylonitrile, polyvinyl acetate, polyvinyl alcohol, poly vinyl butyral, polyvinyl chloride, polyvinyl carbazole, polyvinyl ethers, and polyvinyl ketones; fluorocarbons such as polytetrafluoroethylene, polyvinyl fluoride, polyvinylidene fluoride; and polychlorotrifluoroethylene; polyamides such as polycaprolactam and polyhexamethylene adipamide; polyesters such as polyethylene terephthalate; polyurethanes; polysulfides, polycarbonates; thermosetting resins including phenolic resins such as phenol-formalidehyde, phenol-furfural and resorcinol formaldehyde; amino resins such as urea-formaldehyde and melamine-formaldehyde; polyester resins; epoxy resins; and the like. Many of the foregoing and other typical carrier coating materials are described by L. E. Walkup in U.S. Pat. No. 2,618,551; B. B. Jacknow, et al. in U.S. Pat. No. 3,526,433; and R. J. Hagenbach, et al. in U.S. Pat. Nos. 3,533,835 and 3,658,500.

When the high surface area carrier materials of this invention are coated, any suitable electrostatographic carrier coating thickness may be employed. However, a carrier coating having a thickness at least sufficient to form a thin continuous film on the carrier particle is preferred because the carrier coating will then possess sufficient thickness to resist abrasion and prevent pinholes which adversely effect the triboelectric properties of the coated carrier particles. Generally, for cascade and magnetic brush development, the carrier coating may comprise from about 0.1 percent to about 10.0 percent by weight based on the weight of the coated carrier particles. Preferably, the carrier coating should comprise from about 0.3 percent to about 1.5 percent by weight based on the weight of the coated carrier particles because maximum durability, toner impaction resistance, and copy quality are achieved. To achieve further variation in the properties of the coated composite carrier particles, well-known additives such as plasticizers, reactive and non-reactive polymers, dyes, pigments, wetting agents and mixtures thereof may be mixed with the coating materials.

When the high surface area carrier materials of this invention are coated, the carrier coating composition may be applied to the carrier cores by any conventional method such as spraying, dipping, fluidized bed coating, tumbling, brushing and the like. The coating compositions may be applied as a powder, a dispersion, solution, emulsion or hot melt. When applied as a solution, any suitable solvent may be employed. Solvents having relatively low boiling points are preferred because less energy and time is required to remove the solvent subsequent to application of the coating to the carrier cores. If desired, the coating may comprise resin monomers which are polymerized in situ on the surface of the cores or plastisols gelled in situ to a non-flowable state on the surface of the cores. Surprisingly, it has been found that for a given inefficient coating process, carrier core materials having the specific surface areas designated in this invention results in increased effective area, that is, triboelectric charging coated area per unit weight. Thus, increased carrier active area increases the net toner material triboelectric charge level for a given toner concentration by weight in a developer mixture. Therefore, where it is preferred to operate an electrostatographic development system at a minimum toner concentration as to provide solid area coverage and at a toner concentration high enough to minimize toner deposits in background areas of a developed electrostatic latent image resulting from toner particles having a low or weak triboelectric charge, these objectives may be attained by employing the high surface area carrier materials of this invention. In accordance with this invention, the aforementioned objectives are attained by operating at a decreased toner concentration providing lower background deposits and enabling longer developer life.

Any suitable organic or inorganic photoconductive material may be employed as the recording surface with the classified developer materials of this invention. Typical inorganic photoconductor materials include: sulfur, selenium, zinc sulfide, zinc oxide, zinc cadmium sulfide, zinc magnesium oxide, cadium selenide, zinc silicate, calcium strontium sulfide, cadmium sulfide, mercuric iodide, mercuric oxide, mercuric sulfide, indium trisulfide, gallium selenide, arsenic disulfide, arsenic trisulfide, arsenic triselenide, antimony trisulfide, cadmium sulfo-selenide and mixtures thereof. Typical organic photoconductors include: guinacridone pigments, phthalocyanine pigments, triphenylamine, 2,4-bix(4,4'-diethylamino-phenol)-1,3,4,-oxadiazol N-isopropylcarbazol, triphenylpyrrol, 4,5-diphenyl-imidazolidinone, 4,5-diphenyl-imidazolidinethione, 4,5-bix-(4'-amino-phenyl)-imidazolidinone, 1,5-dicyanonaphthalene, 1,4-dicyanonaphthalene, aminophthalodinitrile, nitrophthalodinitrile, 1,2,5,6-tetraazacyclooctatetraene-(2,4,6,8), 2-mercaptobenzothiazole-2-phenyl-4-disphenylideneoxazolone, 6-hydroxy-2,3-di(p-methoxyphenyl)-benzofurane, 4-dimethylaminobenzylidene-benzhydrazide, 3-benzylidene-aminocarbazole, polyvinyl carbazole, (2-nitrobenzylidene)-p-bromoaniline, 2,4-diphenylquinazoline, 1,2,4-triazine, 5-diphenyl-3-methyl-pyrazoline, 2-(4'dimethylamino phenyl)-benzoxazole, 3-aminecarbazole, and mixtures thereof. Representative patents in which photoconductive materials are disclosed include U.S. Pat. No. 2,803,542 to Ullrich, U.S. Pat. No. 2,970,906 to Bixby, U.S. Pat. No. 3,121,006 to Middleton, U.S. Pat. No. 3,121,007 to Middleton, and U.S. Pat. No. 3.151,982 to Corrsin.

DESCRIPTION OF PREFERRED EMBODIMENTS

The following examples further define, describe and compare methods of preparing the developer materials of the present invention and of utilizing them to develop electrostatic latent images. Parts and percentages are by weight unless otherwise indicated.

In the following examples, toner impaction is measured by a spectrophotometric technique. In general, a 3–5 gram sample of the developer is weighed accurately. Next it is washed with an aqueous surfactant solution to remove loose, non-impacted toner. A quantity of the appropriate solvent is added aimed at dissolving the impacted toner polymer and suspending the carbon black. The mixture of solution and suspended carbon black is ultra-sonified to disperse the carbon black. The resultant suspension is transferred to a volumetric flask and diluted with additional solvent to the mark. The apparent absorbance of the suspension is measured in the visible region. This is compared to a standard curve derived from the virgin toner used to prepare the developer. The concentration of impacted toner is calculated from the absorbance of the sample dispersion. Generally it has been found most useful to measure the rate of toner impaction throughout any machine test. For practical considerations, the number of measurements has to be limited and very good results have been obtained based upon toner impaction during the first 50,000 copies during any test. The rate of toner impaction is calculated from the milligrams of impacted toner polymer per gram of developer per 1,000 copies.

Further, in the following examples, the toner materials were classified employing an Acucut Model B18 unit available from the Donaldson Company, Inc., Tulsa, Oklahoma.

EXAMPLE I

A control developer mixture is prepared by mixing a toner composition comprising a mixture of about 90 parts by weight of a copolymer of about 58.0 percent by weight of styrene and about 42.0 percent by weight of n-butyl methacrylate, and about 10 parts by weight of a furnace carbon black with carrier particles. The toner particles were determined to have a particle size number distribution fine index of about 1.70, a particle size volume distribution coarse index of about 1.40, and a particle size distribution wherein about 50 percent of the toner particles had an average particle diameter of less than about 5 microns, about 23 percent by number of the toner particles had an average particle diameter of between about 5 microns and about 8 microns, about 15 percent by number of the toner particles had an average particle diameter of between about 8 microns and about 12 microns, about 7 percent by number of the toner particles had an average particle diameter of between about 12 microns and about 20 microns, and about 5 percent by number of the toner particles had an average particle diameter of more than 20 microns. The carrier particles comprised nickel-zinc ferrite coated with about 0.6% by weight, based on the weight of the core material, of a carrier coating composition comprising styrene, a methacrylate ester, and an organosilicon compound as disclosed in U.S. Pat. No. 3,526,533. The coated ferrite carrier material is determined by seive analysis to have a particle size distribution as follows:

| U.S. Seive | % By Weight |
|---|---|
| 70 mesh (210μ) | 0 |
| 80 mesh (177μ) | 0 |
| 100 mesh (149μ) | .1 |
| 120 mesh (125μ) | .1 |
| 140 mesh (105μ) | 7.2 |
| 170 mesh (88μ) | 30.4 |
| 200 mesh (74μ) | 30.7 |
| 230 mesh (63μ) | 25.5 |
| 270 mesh (54μ) | 5.7 |
| 325 mesh (44μ) | 0.2 |
| Pan | 0 |

By calculation, the coated ferrite carrier material is determined to have a specific surface area of about 128 $cm^2$/gram. About 1 part by weight of the toner particles was mixed with about 100 parts by weight of the carrier particles to form the developer mixture. Copies of a standard test pattern were made with the developer mixture in an electrostatographic copying machine employing a magnetic brush development system. It was found that the developer mixture failed after about 100,000 copies. Developer failure was experienced in the form of high background, i.e., exceeding the specified 0.01 background density level at 1.0 solid area density. A high level of photoreceptor filming was observed as print-out on the copies occurred at a frequency of about every 15,000 copy intervals. The rate of toner impaction was found to be about 0.0450.

EXAMPLE II

A developer mixture is prepared by mixing about 1 part of the toner material employed in Example I with about 100 parts of the carrier material employed in Example I except that the toner particles were determined to have a particle size number distribution fine index of about 2.07, a particle size volume distribution course index of about 1.40, and a particle size distribution wherein about 29 percent of the toner particles had an average particle diameter of less than about 5 microns, about 30 percent by number of the toner particles had an average particle diameter of between about 5 microns and about 8 microns, about 25 percent by number of the toner particles had an average particle diameter of between about 8 microns and about 12 microns, about 11 percent by number of the toner particles had an average particle diameter of between about 12 microns and about 20 microns, and about 5 percent by number of the toner particles had an average particle diameter of more than 20 microns. The carrier material was determined by seive analysis to have the following particle size distribution:

| U.S. Seive | % By Weight |
|---|---|
| 70 mesh (210μ) | 0 |
| 80 mesh (177μ) | 0 |
| 100 mesh (149μ) | 0.8 |
| 120 mesh (125μ) | 5.9 |
| 140 mesh (105μ) | 21.4 |

-continued

| U.S. Seive | % By Weight |
|---|---|
| 170 mesh (88μ) | 40.3 |
| 200 mesh (74μ) | 28.5 |
| 230 mesh (63μ) | 1.4 |
| 270 mesh (54μ) | 1.4 |
| 325 mesh (44μ) | 0.3 |
| Pan | 0 |

By calculation, the coated ferrite carrier material is determined to have a specific surface area of about 151 $cm^2$/gram. The developer is used to develop an electrostatic latent image under substantially the same conditions as in Example I. It was found that the developer mixture performed satisfactorily up to about 225,000 copies. A lower level of photoreceptor filming was observed as print-out on the copies at a frequency of about every 25,000 copy intervals. The rate of toner impaction was found to be about 0.0280.

EXAMPLE III

A developer mixture is prepared by mixing about 1 part of the toner material employed in Example I with about 100 parts of the carrier material employed in Example I except that the toner particles were determined to have a particle size number distribution fine index of about 2.60, a particle size volume distribution coarse index of about 1.35, and a particle size distribution wherein about 23 percent of the toner particles had an average particle diameter of less than about 5 microns, about 18 percent by number of the toner particles had an average particle diameter of between about 5 microns and about 8 microns, about 35 percent by number of the toner particles had an average particle diameter of between about 8 microns and about 12 microns, about 19 percent by number of the toner particles had an average particle diameter of between about 12 microns and about 20 microns, and about 5 percent by number of the toner particles had an average particle diameter of more than 20 microns. The carrier material was determined by seive analysis to have the following particle size distribution:

| U.S. Seive | % By Weight |
|---|---|
| 70 Mesh (210μ) | 0 |
| 80 Mesh (177μ) | 0 |
| 100 Mesh (149μ) | 0 |
| 120 Mesh (125μ) | 0.16 |
| 140 Mesh (105μ) | 13.8 |
| 170 Mesh (88μ) | 35.1 |
| 200 Mesh (74μ) | 40.9 |
| 230 Mesh (63μ) | 7.59 |
| 270 Mesh (54μ) | 1.86 |
| 325 Mesh (44μ) | .53 |
| Pan | 0.06 |

By calculation, the coated ferrite carrier material is determined to have a specific surface area of about 160 $cm^2$/gram. The developer is used to develop an electrostatic latent image under substantially the same conditions as in Example I. It was found that the developer mixture performed satisfactorily up to about 375,000 copies. A lower level of photoreceptor filming was observed as print-out on the copies at a frequency of about every 35,000 copy intervals. The rate of toner impaction was found to be about 0.0220.

EXAMPLE IV

A developer mixture is prepared by mixing about 1 part of the toner material employed in Example I with about 100 parts of the carrier material employed in Example I except that the toner particles were determined to have a particle size number distribution fine index of about 2.25, a particle size volume distribution coarse index of about 1.35, and a particle size distribution wherein about 21 percent of the toner particles had an average particle diameter of less than about 5 microns, about 15 percent by number of the toner particles had an average particle diameter of between about 5 microns and about 8 microns, about 40 percent by number of the toner particles had an average particle diameter of between about 8 microns and about 12 microns, about 19 percent by number of the toner particles had an average particle diameter of between about 12 microns and about 20 microns, and about 5 percent by number of the toner particles had an average particle diameter of more than 20 microns. The carrier material was determined by seive analysis to have the following particle size distribution:

| U.S. Seive | % By Weight |
|---|---|
| 70 Mesh (210μ) | 0 |
| 80 Mesh (177μ) | 0 |
| 100 Mesh (149μ) | 0 |
| 120 Mesh (125μ) | 0 |
| 140 Mesh (105μ) | 5.7 |
| 170 Mesh (88μ) | 44.7 |
| 200 Mesh (74μ) | 34.9 |
| 230 Mesh (63μ) | 10.9 |
| 270 Mesh (54μ) | 3.7 |
| 325 Mesh (44μ) | .13 |
| Pan | 0 |

By calculation, the coated ferrite carrier material is determined to have a specific surface area of about 168 $cm^2$/gram. The developer is used to develop an electrostatic latent image under substantially the same conditions as in Example I. It was found that the developer mixture performed satisfactorily up to 325,000 copies when the test was suspended. A lower level of photoreceptor filming was observed as print-out on the copies at a frequency of about every 50,000 copy intervals. The rate of toner impaction was found to be about 0.0140.

EXAMPLE V

A developer mixture is prepared by mixing about 1 part of the toner material employed in Example I with about 100 parts of the carrier material employed in Example I except that the toner particles were determined to have a particle size number distribution fine index of about 1.70, a particle size volume distribution coarse index of about 1.33, and a particle size distribution wherein about 13 percent of the toner particles had an average particle diameter of less than about 5 microns, about 12 percent by number of the toner particle had an average particle diameter of between about 5 microns and about 8 microns, about 50 percent by number of the toner particles had an average particle diameter of between about 8 microns and about 12 microns, about 20 percent by number of the toner particles had an average particle diameter of between about 12 microns and about 20 microns, and about 5 percent by number of the toner particles had an average particle diameter of more than 20 microns. The carrier material was determined by seive analysis to have the following particle size distribution:

| U.S. Seive | % By Weight |
|---|---|
| 70 Mesh (210μ) | 0 |
| 80 Mesh (177μ) | .2 |
| 100 Mesh (149μ) | 1.7 |
| 120 Mesh (125μ) | 4.5 |
| 140 Mesh (105μ) | 7.5 |
| 170 Mesh (88μ) | 10.3 |
| 200 Mesh (74μ) | 62.4 |
| 230 Mesh (63μ) | 2.6 |
| 270 Mesh (54μ) | 5.1 |
| 325 Mesh (44μ) | 5.1 |
| Pan | .51 |

This distribution was reconstructed artificially and does not satisfy a log-normal plot for a geometric standard deviation calculation. By calculation, the coated ferrite carrier material is determined to have a specific surface area of about 177 $cm^2$/gram. The developer is used to develop an electrostatic latent image under substantially the same conditions as in Example I. It was found that the developer mixture performed satisfactorily up to 400,000 copies when the test was suspended. A low level of photoreceptor filming was observed as print-out on the copies at a frequency of about every 135,000 copy intervals. The rate of toner impaction was found to be about 0.0117.

Thus, highly classified developer materials of this invention are characterized as providing improved copy quality experienced in reduced toner deposits in background areas. In addition, developer materials of this invention are further characterized as resulting in improved machine performance with longer systems life, that is, these developer materials provide substantially improved triboelectric charging properties of the developer mixtures for substantially longer periods of time thereby increasing the developer life of the developer mixtures and decreasing the time intervals between replacement of the developer materials. Further still, the developer materials of this invention may be characterized as providing dense toner images and are particularly useful in magnetic brush development systems. Thus, by providing the developer materials of this invention, substantial improvements in systems life due to intrinsic developer life result upon the classification and use of developer materials having ten specified physical characteristics.

In addition, the developer materials of this invention may be further characterized as experiencing substantially reduced impaction rates resulting in more stable triboelectric charging properties of the developer mixtures for substantially longer periods of time thereby increasing the developer life of the developer mixtures and decreasing the time intervals between replacement of the developer materials.

The expressions "developing material" and "developer mixture" as employed herein are intended to include toner material or combinations of toner material and carrier material.

Although specific materials and conditions are set forth in the above examples of making and using the developer materials of this invention, these are merely intended as illustrations of the present invention. These and other high surface area carrier materials, toner materials, substituents, and processes, such as those listed above, may be substituted for those in the Examples with similar results.

Other modifications of the present invention will occur to those skilled in the art upon a reading of the present disclosure. These are intended to be included within the scope of this invention.

What is claimed is:

1. An electrostatographic developer mixture comprising toner particles electrostatically clinging to the surface of carrier materials, said toner particles comprising toner particles classified as to particle size wherein said toner particles have a particle size number distribution fine index ratio of less than about 2.50, a particle size volume distribution coarse index ratio of less than about 1.50, and a particle size distribution wherein less than about 30.0 percent by number of the toner particles have an average particle size diameter of less than about 5 microns, about 25 percent by number of the particles have a diameter between about 8 microns and about 12 microns, and less than about 5 percent by number of the toner particles have an average particle diameter greater than about 20 microns, said carrier materials comprise carrier particles classified as to surface area having a specific surface area of at least about 150 $cm^2$/gram, a particle size volume distribution geometric standard deviation of less than about 1.3, and a volume average particle diameter of less than about 100 microns, said developer mixture being further characterized as experiencing substantially reduced toner impaction rates resulting in more stable triboelectric charging properties for substantially longer periods of time thereby increasing the developer life of said developer mixture.

2. An electrostatographic developer mixture according to claim 1 wherein said carrier materials have a specific surface area of at least about 165 $cm^2$/gram.

3. An electrostatographic developer mixture according to claim 1 wherein said carrier materials have a specific surface area of at least about 175 $cm^2$/gram.

4. An electrostatographic developer mixture according to claim 1 wherein said toner particles have a particle size number distribution fine index of less than about 2.00.

5. An electrostatographic developer mixture according to claim 1 wherein said toner particles have a particle size number distribution fine index of less than about 1.45.

6. An electrostatographic developer mixture according to claim 1 wherein said toner particles have a particle size volume distribution coarse index of less than about 1.45.

7. An electrostatographic developer mixture according to claim 1 wherein said toner particles have a particle size volume distribution coarse index of less than about 1.35.

8. An electrostatographic developer mixture according to claim 1 wherein said toner particles have a particle size distribution wherein less than about 20 percent by number of the toner particles have an average particle diameter of less than about 5 microns, about 45 percent by number of the toner particles have an average particle diameter of between about 8 microns and about 12 microns, and less than about 5 percent by number of the toner particles have an average particle diameter greater than about 20 microns.

9. An electrostatographic developer mixture according to claim 1 wherein said toner particles have a particle size distribution wherein less than about 10 percent by number of the toner particles have an average particle diameter of less than about 5 microns, about 60 percent by number of the toner particles have an average particle diameter of between about 8 microns and about 12 microns, and less than about 5 percent by number of the toner particles have an average particle diameter greater than about 20 microns.

10. An electrostatographic developer mixture according to claim 1 wherein said carrier materials have a particle size volume distribution geometric standard deviation of less than about 1.2 and a volume average particle diameter of less than about 90 microns.

11. An electrostatographic developer mixture according to claim 1 wherein said carrier materials have a volume distribution geometric standard deviation of less than about 1.15 and a volume average particle diameter of less than about 85 microns.

12. An electrostatographic developer mixture according to claim 1 wherein said carrier materials are overcoated with a thin continuous film of a coating material.

13. An electrostatographic developer mixture according to claim 12 wherein said coating material comprises from about 0.1 percent to about 10.0 percent by weight based on the weight of the coated carrier particles.

14. An electrostatographic developer mixture according to claim 1 wherein said carrier particles comprise nickel-zinc-ferrite beads coated with a thin continuous film of a coating composition comprising styrene, a methacrylate ester, and an organosilicon compound.

15. An electrostatographic developer mixture according to claim 1 wherein said toner particles comprise a mixture of about 90 parts by weight of a copolymer of about 58.0 percent by weight of styrene, and about 42.0 percent by weight of n-butyl methacrylate, and about 10 parts by weight of a furnace carbon black.

* * * * *